US005289793A

United States Patent [19]

Aker

[11] Patent Number: 5,289,793

[45] Date of Patent: Mar. 1, 1994

[54] HELICONIC THRUSTER SYSTEM FOR A MARINE VESSEL

[75] Inventor: Charles M. Aker, Lake Forest, Calif.

[73] Assignee: Omnithruster Inc., Santa Fe Spring, Calif.

[21] Appl. No.: 870,667

[22] Filed: Apr. 17, 1992

[51] Int. Cl.[5] ..... B63H 25/46

[52] U.S. Cl. ..... 114/151; 60/222; 440/38; 440/46; 440/47

[58] Field of Search ..... 114/150, 151; 60/221, 60/222; 440/38, 40, 41, 42, 43, 46, 47

[56] References Cited

U.S. PATENT DOCUMENTS

| | | | |
|---|---|---|---|
| 6,468 | 5/1849 | Ruthven | 60/221 |
| 3,046,735 | 7/1962 | Burgin | 60/222 |
| 3,055,175 | 9/1962 | Clark | 60/221 |
| 3,105,353 | 10/1963 | Schulz | 60/221 |
| 3,128,740 | 4/1964 | Burgin | 60/222 |
| 3,295,490 | 1/1967 | Hiatt | 60/221 |
| 3,465,523 | 9/1969 | Clark | 60/221 |
| 4,056,073 | 11/1977 | Dashew et al. . | |
| 4,214,544 | 7/1980 | Dashew et al. . | |
| 4,455,960 | 6/1984 | Aker . | |

FOREIGN PATENT DOCUMENTS

| | | | |
|---|---|---|---|
| 641 | 1/1875 | France | 440/38 |
| 2616874 | 12/1988 | France | 251/304 |
| 164463 | 9/1984 | Japan | 251/304 |
| 75614 | 9/1949 | Norway | 440/38 |
| 2777 | of 1890 | United Kingdom | 440/40 |
| 16086 | of 1901 | United Kingdom | 440/38 |
| 567870 | 3/1945 | United Kingdom | 440/42 |
| 1087797 | 10/1967 | United Kingdom | 440/38 |

*Primary Examiner*—Michael S. Huppert
*Assistant Examiner*—Thomas J. Brahan
*Attorney, Agent, or Firm*—Kelly Bauersfeld & Lowry

[57] ABSTRACT

An improved thruster system is provided for maneuvering and/or propulsion of a marine vessel, through the use of directionally oriented water jets discharged tangentially from a helical-conical flow chamber. The thruster system includes a high capacity pump for pumping water through a hull intake to the flow chamber with a substantial helical or swirling action. The water exits the flow chamber through one or more of a plurality of tangentially oriented discharge conduits having discharge nozzles for passage of high velocity water jets through the hull, resulting in reaction forces used to maneuver or propel the vessel. Each discharge conduit includes a valve member movable between open and closed positions for respectively permitting or preventing water flow to the associated nozzle.

20 Claims, 4 Drawing Sheets

HELICONIC THRUSTER SYSTEM FOR A MARINE VESSEL

BACKGROUND OF THE INVENTION

This invention relates generally to thruster systems used particularly for slow speed maneuvering of a marine vessel. More specifically, this invention relates to a compact thruster system designed for energy-efficient generation of one or more directionally oriented water jets used to maneuver and/or propel the marine vessel.

Boat thruster systems are generally known in the art for use in close-quarter maneuvering of a marine vessel. Such thruster systems are designed to generate a flow of water discharged from one side of a boat hull, resulting in a substantial hydraulic reaction force applied to the vessel for improved close-quarter maneuvering. In one traditional form, the thruster system comprises a relatively large diameter propeller mounted within a correspondingly sized transverse opening or tunnel formed in the boat hull, wherein the propeller is adapted to generate a substantial mass flow of water directed to one side of the vessel in accordance with the direction of propeller rotation. While so-called tunnel thrusters of this type provide significant advantages in close-quarter vessel maneuvering, especially upon approach to or departure from a dock, the thruster system occupies a large volumetric space within the hull of the vessel. Moreover, large openings must be formed in the vessel's hull, usually in a dry dock environment, to accommodate installation of the requisite large diameter flow tunnel. As a result, tunnel thruster systems exhibit significant disadvantages with respect to system size and installation cost.

In recent years, alternative and comparatively more compact thruster systems have been designed wherein a high capacity water pump delivers water for discharge as high velocity jets through relatively small nozzles mounted at opposite sides of the vessel's hull. See, for example, U.S. Pat. Nos. 4,056,073; 4,214,544; and 4,455,960. In these thruster systems, the pump draws in water through a downwardly open intake formed in the hull. The water is delivered from the pump through a diffuser and directionally controlled vanes for discharge flow through one of the nozzles, resulting in an hydraulic reaction force which is effective to assist in vessel maneuvering. Water jet thruster systems of this type beneficially occupy significantly less space within the hull of a vessel, and may be installed without requiring large holes to be formed in the hull. Moreover, additional directional vanes and/or additional discharge nozzles may be employed to generate reaction forces in a fore-aft direction for vessel propulsion in close-quarter maneuvers, or as an auxiliary drive source in the event of main engine failure. However, the thrust generation capacity of a water jet system has been relatively inefficient from an energy standpoint, in comparison with tunnel thruster systems.

There exists, therefore, a significant need for improvements in thruster systems of the water jet type, particularly with respect to improving the efficiency of thrust generation. The present invention fulfills this need and provides further related advantages.

SUMMARY OF THE INVENTION

In accordance with the invention, an improved thruster system is provided for a marine vessel for use in maneuvering and/or propulsion of the vessel. The thruster system comprises a high capacity impeller which pumps water into a conic or heliconic flow chamber, with a helical flow pattern, therefore creating a substantial helical-conical flow regime. The water flow is delivered from the heliconic flow chamber through one or more of a plurality of tangentially oriented discharge conduits each leading from the flow chamber to a directionally oriented discharge nozzle. In the preferred form, a pair of the discharge conduits are associated with discharge nozzles mounted respectively at the port and starboard sides of the vessel's hull, and at least one additional discharge conduit is associated with a rearwardly directed nozzle for use in ship propulsion. Valve members are mounted within each of the discharge conduits for permitting or preventing water flow to the associated discharge nozzle.

The pump is designed for drawing a relatively high mass flow of water through an intake formed in the ship's hull, and preferably opening in a downward direction. The pump delivers the water inflow to a lower apex end of the inverted, conically shaped and generally annular heliconic flow chamber, with a substantial spiral or swirling action. The discharge conduits have upstream ends opening generally tangentially into the heliconic flow chamber, in a direction for substantial in-line outflow of water from the flow chamber. A discharge nozzle is mounted at a downstream end of each discharge conduit, in a directionally oriented position located substantially at the ship's hull, for discharging water outwardly therefrom to generate a resultant reaction or thrust force used to maneuver or propel the vessel. In the preferred form, a pair of the discharge conduits extend from the heliconic flow chamber with a substantially linear shape and in opposite directions to laterally aimed discharge nozzles at the port and starboard sides of the vessel. A third discharge conduit extends from the heliconic flow chamber in an aft direction toward the ship's stern, terminating in a rearwardly directed discharge nozzle for generating a forward propulsion reaction force. A fourth discharge conduit may be provided to extend in a direction toward the bow of the vessel, and terminates in a forwardly open discharge nozzle to generate a rearward propulsion force.

Each of the discharge conduits has a valve member mounted therein, preferably at a position relatively close to the heliconic flow chamber. The valve members are separately actuated by a control unit for movement between open and closed positions, respectively permitting or preventing water flow through the associated discharge conduit. In the open position, each valve member defines cross-vanes extending generally coaxially with the tangential direction of water flow to reduce swirl flow components. The control unit is designed to maintain at least one of the valve members in an open position, when the pump is operating, resulting in a reaction or thrust force applied to the ship's hull in a selected direction for maneuvering and/or propulsion of the vessel. In some conditions of operation, the control unit can open a pair of the valve members to permit water flow discharge in opposing directions to result in a zero net thrust applied to the vessel.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention, in such drawings.

DETAILED DESCRIPTION OF THE PREFERRED EMBODIMENTS

Figure 1:
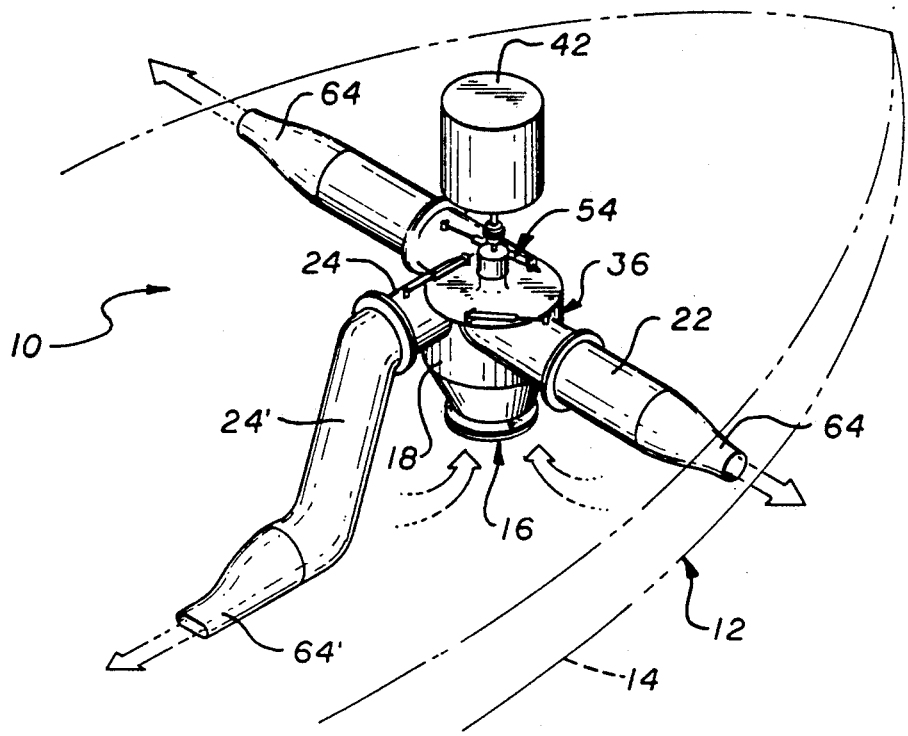
FIG. 1 is a fragmented perspective view, shown somewhat in schematic form, depicting a portion of the hull of a marine vessel having a heliconic thruster system embodying the novel features of the invention installed therein.

As shown in the exemplary drawings, an improved thruster system referred to generally in FIG. 1 by the reference number 10 is provided for close-quarter maneuvering and/or drive propulsion of a marine vessel 12 through the use of directionally oriented water jets discharged from the hull 14 in selected directions. The thruster system 10 includes a pump 16 for supplying water at a high mass flow rate to a helical-conical, or heliconic flow chamber 18, and further through one or more of a plurality of tangentially oriented discharge conduits, with three discharge conduits 20, 22, and 24 being depicted in FIGS. 1 and 2.

Figure 3:
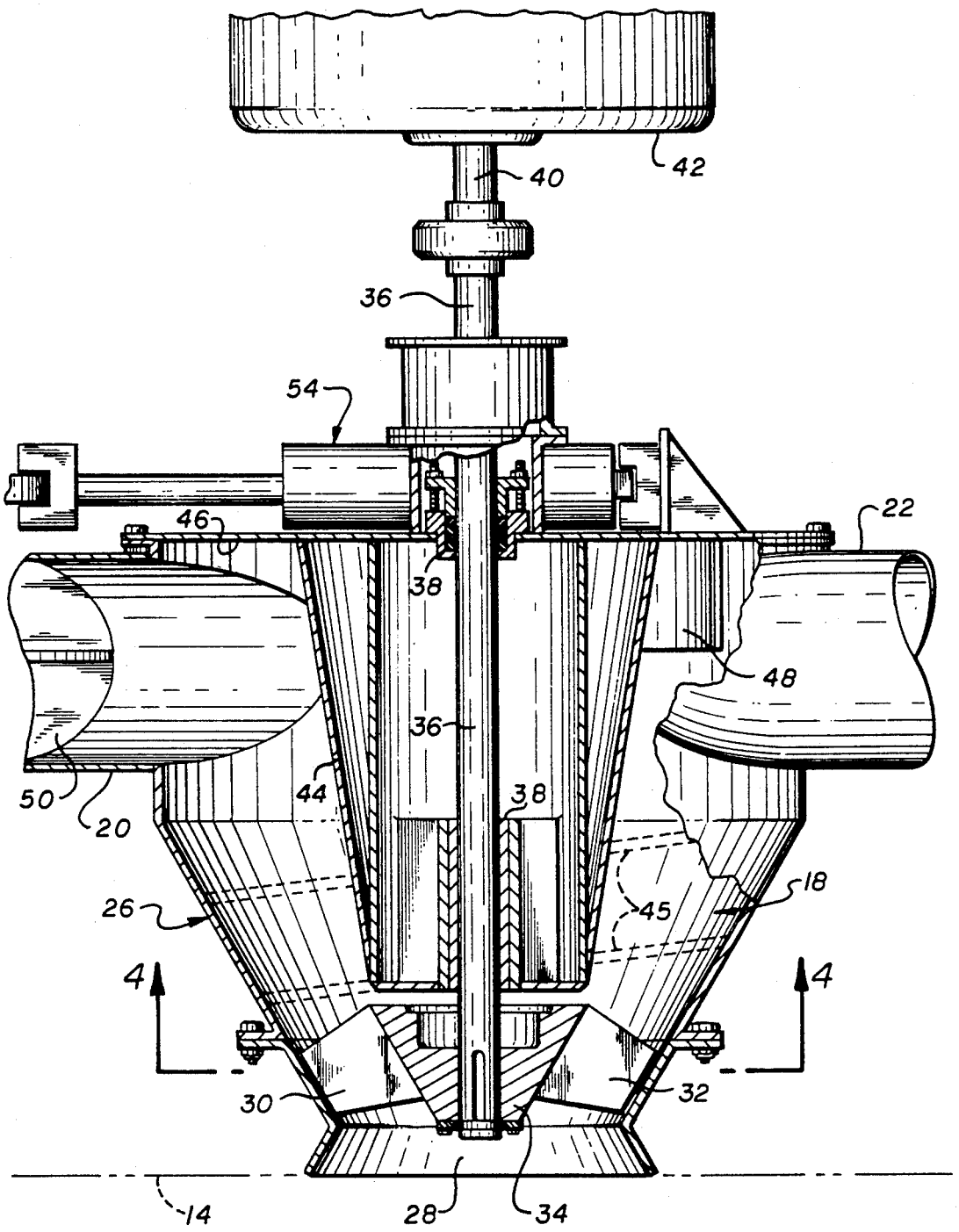
FIG. 3 is an enlarged fragmented vertical sectional view of the improved thruster system.

More specifically, the thruster system 10 is designed for installation into the ship's hull 14 at a convenient and suitable position, such as at a location near the bow end thereof, as depicted in FIG. 1. Alternately, the thruster system may be positioned near the stern of the vessel, or at any other convenient location. The system includes a housing 26 having a lower end defining an open intake 28 for water inflow when the pump 16 is operated. A pump impeller 30 (FIG. 3) is mounted within a lower region of the housing 26, at a position inset a short distance from the intake 28. The illustrative and preferred pump impeller 30 comprises an annular array of impeller vanes 32 of hybrid or mixed axial and centrifugal flow design mounted on a hub 34, which is carried in turn at the lower end of a drive shaft 36. FIG. 3 illustrates the drive shaft 36 extending vertically through the housing 26, supported for rotation by appropriate bearings 38, with an upper end of the drive shaft 36 connected to the output shaft 40 of a suitable overhead mounted drive motor 42.

The impeller 30 operates to draw in a high mass flow of water into the housing 26, via the intake 28. This water flow is delivered by the impeller to an upper region of the housing 26, wherein this upper housing region is geometrically shaped to define the heliconic flow chamber 18. FIG. 3 illustrates the housing 26 shaped to include an outer wall defined by a conical lower segment which expands diametrically from the pump impeller 30 in an upward direction to an upper, coaxially oriented cylindrical segment. These conical and cylindrical housing segments surround a centrally located flow forming wall 44 which depends from an upper wall 46 of the housing 26. The flow forming wall 44 has a truncated conical cross section which expands progressively from a lower end disposed in close proximity with the impeller 30. The heliconic flow chamber 18 is defined by the annular space between the flow forming wall 44 and the outer wall formed by the conical and cylindrical housing segments.

Figure 4:
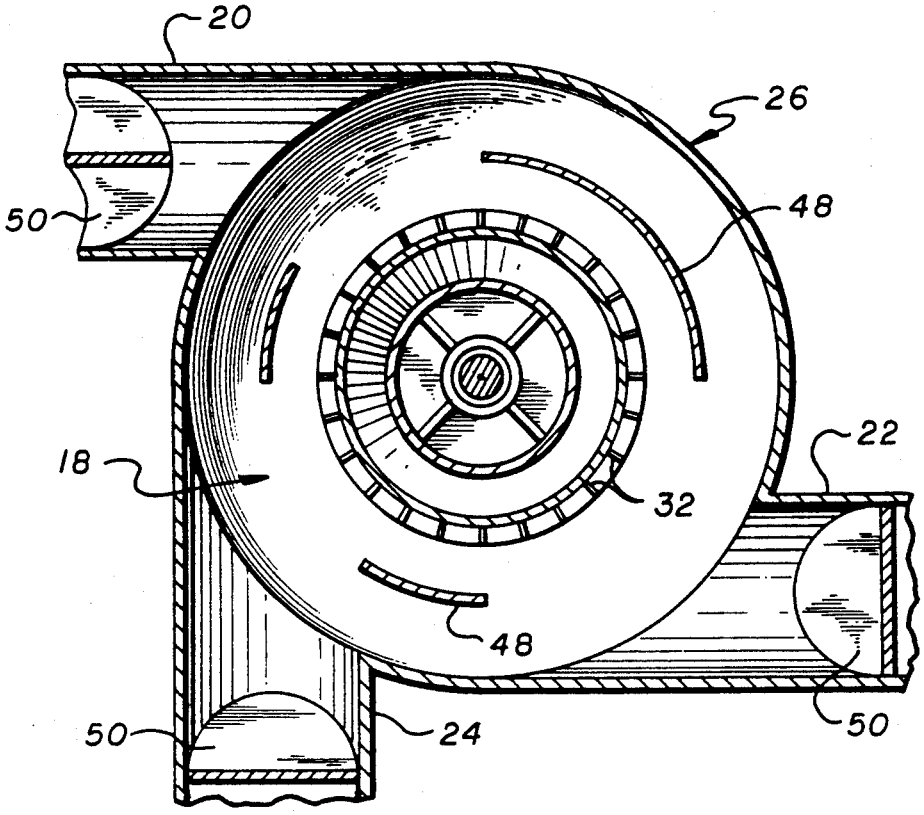
FIG. 4 is a horizontal sectional view taken generally on the line 4—4 of FIG. 3.
Figure 5:
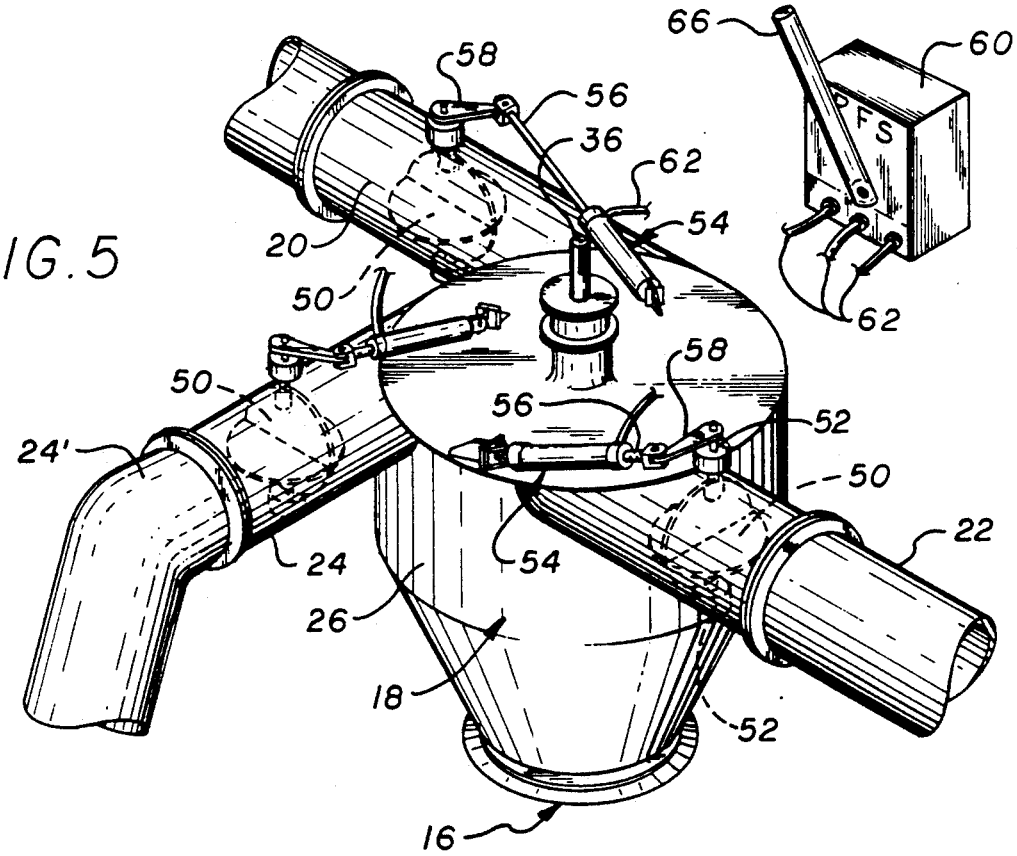
FIG. 5 is a fragmented perspective view, similar to FIG. 1, and depicting a control unit and associated valve means for regulating water flow through the thruster system.

In operation, the impeller 30 delivers the high mass flow of water in an upward direction to the heliconic flow chamber 18 with a substantial swirling or spiralling flow action. This heliconic water flow expands upwardly through the flow chamber 18, with minimal backpressure and/or flow losses associated therewith. A spiral vane 45 may be provided within the conical lower segment of the flow chamber to minimize or inhibit recirculation flow. The discharge conduits 20, 22 and 24 have upstream ends connected to the upper cylindrical segment of the housing 26 in substantial alignment with a tangential direction of water swirl flow therein. Stabilizer vanes 48 (FIGS. 3 and 4) may be provided within the flow chamber 18 to extend downwardly from the housing top wall 46, wherein the stabilizer vanes 48 (FIGS. 3 and 4) have an arcuate shape for guiding the swirling water flow around the flow chamber. As shown in FIG. 5, the arcuate lengths of the stability vanes are chosen to avoid interference with tangential water flow to the discharge conduits.

Each of the three illustrative discharge conduits 20, 22 and 24 has a valve member 50 mounted therein for permitting or preventing water flow from the heliconic flow chamber 18. More particularly, as shown in FIG. 5 in one preferred form, each valve member 50 comprises a pair of circular vanes connected to intersect at right angles, and mounted by axle pins 52 for rotational movement between open and closed positions. In the open position, as viewed with respect to the discharge conduit 20, the vanes are oriented to extend in a plane coaxial with a longitudinal axis of the discharge conduit. Thus, in the open position, the vanes of the valve member 50 present an X-shaped profile to the discharge water flow for purposes of reducing or minimizing energy losses attributable to swirling action within the discharge conduit. In addition, when the pump 16 is not operating, the X-shaped profile defined by the vanes functions to resist backflow ingestion of debris into the flow chamber 18.

By contrast, when the valve member 50 is in the closed position, one of the circular vanes is rotated to a position extending transversely across the associated discharge conduit, as viewed in FIG. 5 with respect to the discharge conduits 22 and 24. In this closed position, the valve member prevents water flow through the discharge conduit. In this regard, all of the valve members 50 are desirably mounted within their respective discharge conduits at a position in close proximity to the heliconic flow chamber 18, for purposes of minimizing any flow stagnation zones at the upstream sides of the valve members and/or flow disturbances or related flow losses which may be associated therewith.

The valve members 50 mounted within the discharge conduits are separately actuated to permit tangential discharge flow of water from the heliconic flow chamber 18 through at least one of the discharge conduits whenever the pump 16 is operating. FIG. 5 depicts a trio of pneumatic actuator units 54 associated individually with the illustrative three valve members 50. The actuator units 54 include extensible rams 56 connected via crank links 58 to the valve member axle pins 52 to displace the valve members between the open and closed positions in response to fluid pressure signals received from a control unit 60 via pressure lines 62. The actuator units 54 are controlled by the control unit 60 to insure that at least one of the valve members 50 is open during pump operation to prevent pump overloading and/or resultant pump damage, as described in U.S. Pat. No. 4,455,960, which is incorporated by reference herein. However, it will be understood by those skilled in the art that other actuator devices and mechanisms may be used to control the positions of the plurality of valve members 50.

Figure 2:
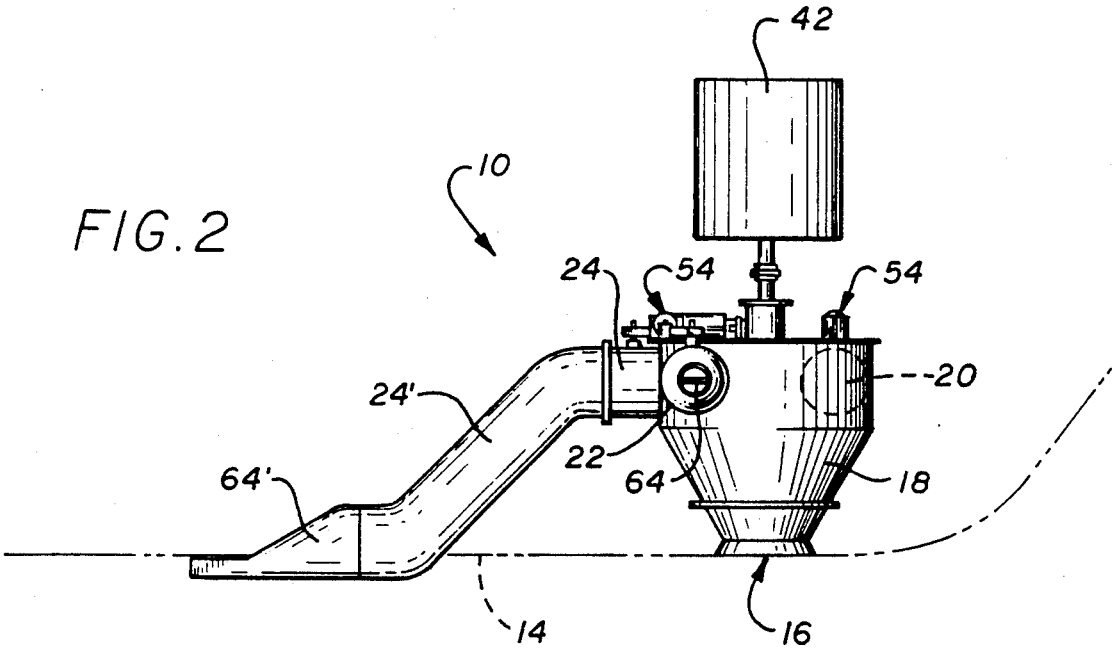
FIG. 2 is a fragmented starboard side elevational view of the thruster system depicted in FIG. 1.

With reference to FIGS. 2 and 5, the discharge conduits 20 and 22 are shown to extend with a substantially linear shape from the flow chamber 18 toward the port and starboard sides, respectively, of the ship's hull 14. These discharge conduits 20 and 22 each terminate at the hull in a converging discharge nozzle 64 through which a high velocity water jet can be discharged from the hull, preferably at a location below the normal water line of the vessel. Appropriate adjustment of the control unit 60, as by manual movement of a control switch or lever 66 (FIG. 5), will operate the valve members 50 within the discharge conduits 20, 22 to permit water flow as a high velocity jet from the port and/or starboard side of the vessel. Such water jet discharge results in a port- or starboard-directed reaction force to assist in vessel maneuvering. Alternately, the control unit may be designed to open the valve members 50 associated with both of the conduits 20 and 22, resulting in high velocity jets issued from the hull in offsetting opposite directions.

The third discharge conduit 24 shown in FIGS. 1, 2 and 5 extends from the flow chamber 18 in an aft direction toward the stern of the vessel. This discharge conduit 24 terminates in a converging discharge nozzle 64' aimed in an aft direction for rearward discharge of a water jet, resulting in a forward reaction force which may be used to propel the vessel in close-quarter maneuvering, or as an alternative vessel drive source in the event of main engine failure. The drawings show the discharge conduit 24 to include a downwardly angled segment 24' terminating in the discharge nozzle 64' of relatively low profile elliptical geometry nested against the underside of the hull 14.

Figure 6:
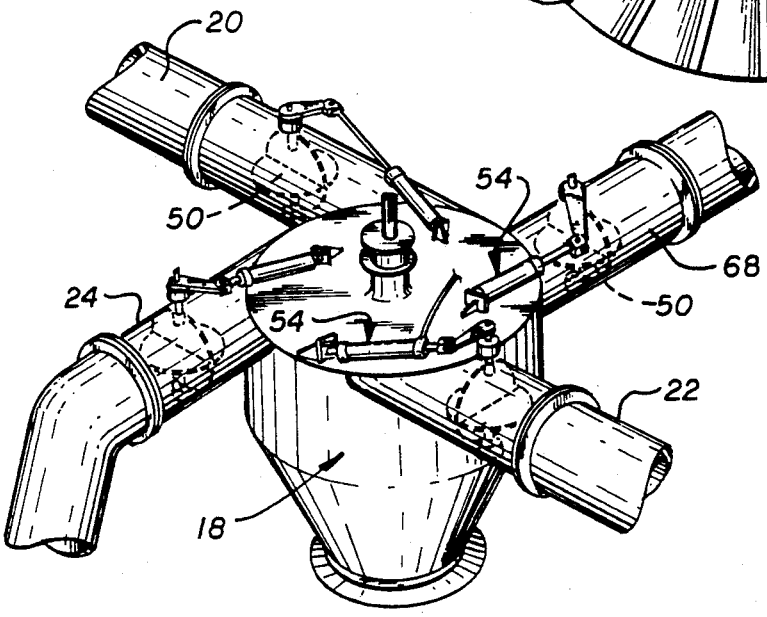
FIG. 6 is a fragmented perspective view similar to FIG. 5, and illustrating an alternative preferred form of the invention.

FIG. 6 illustrates an alternative form of the invention, wherein components identical to those shown and described in FIGS. 1-5 are identified by common reference numerals. In the embodiment of FIG. 6, a fourth tangentially oriented discharge conduit 68 is connected to the heliconic flow chamber 18 to extend forwardly therefrom toward the bow of the vessel. A valve member 50 and related actuator means are provided to permit or prevent water flow through this fourth discharge conduit 68 which terminates in a forwardly aimed discharge nozzle (not shown) designed to produce a reaction force for rearward vessel propulsion. Thus, in the embodiment of FIG. 6, appropriate operation of the valve members within the discharge conduits permits close quarter vessel maneuvering in the forward, rearward, port and starboard directions, or any combination thereof.

Figure 7:
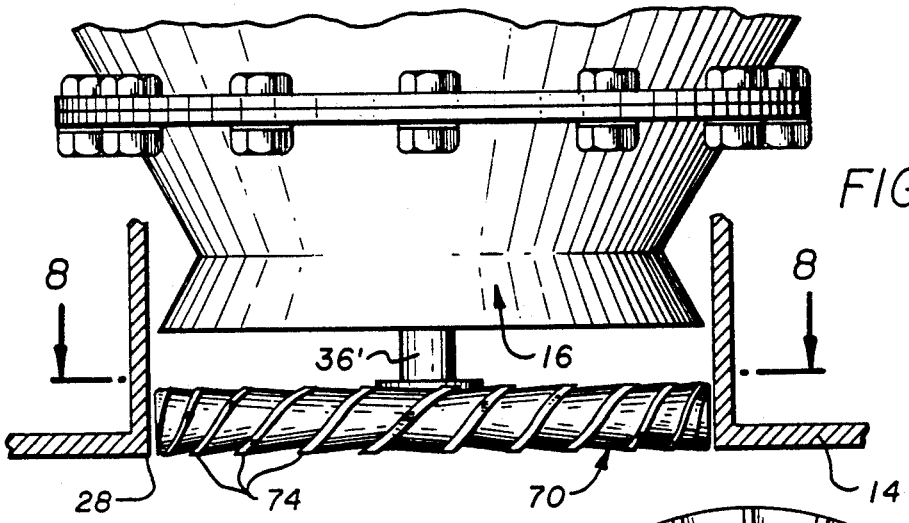
FIG. 7 is an enlarged fragmented side elevational view depicting another alternative preferred form of the invention.
Figure 8:
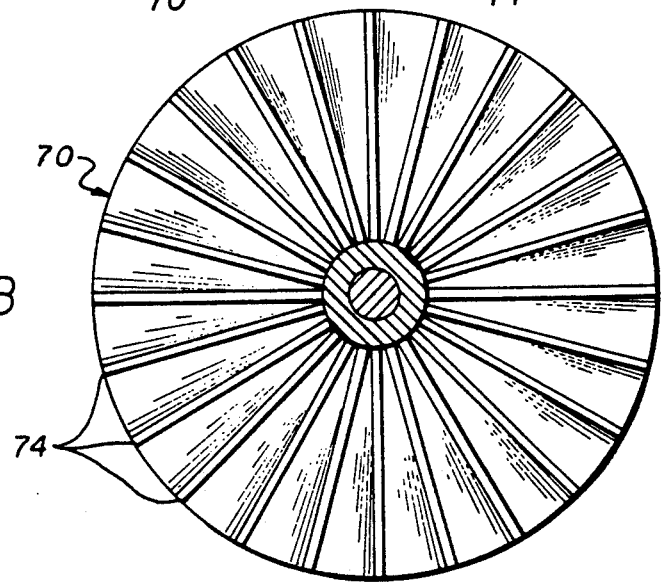
FIG. 8 is a horizontal sectional view taken generally on the line 8—8 of FIG. 7.

FIGS. 7 and 8 illustrate a further modification of the invention, wherein an auxiliary impeller 70 is mounted on an extension 36' of the drive shaft 36 at a position below the main impeller 30. This auxiliary impeller 70 includes an outwardly radiating plurality of vanes 74 each angularly shaped or swept to draw in water through the intake 28 when the pump 16 is operated. The provision of the auxiliary impeller 70 near or substantially at the intake 28 improves overall pump flow capacity, while generating a secondary centrifugal flow action at the periphery of the impeller 70 which assists is sweeping floating debris away from the intake 28.

The improved thruster system 10 of the present invention has been found to produce substantial propulsive thrust in an energy efficient manner compatible with so-called tunnel thruster systems of the prior art, but in a compact system package adapted for comparatively easy and cost-effective installation. Moveover, the invention provides versatile operation to generate side thrust forces and/or fore-aft propulsive forces to maneuver the vessel, with each discharge nozzle oriented in the desired direction of thrust generation for maximum maneuvering efficiency.

A variety of further modifications and improvements to the thrust system 10 of the present invention will be apparent to these persons skilled in the art. Accordingly, no limitation on the invention is intended by way of the foregoing description and accompanying drawings, except as set forth in the appended claims.

What is claimed is:

1. A thruster system for a marine vessel, comprising:

housing means including a generally annular outer wall having a lower conical segment expanding in an upward direction from a lower apex end and joined to an upper cylindrical segment, a top wall closing the upper end of said housing means, and a flow forming wall disposed centrally within said housing means and cooperating with said outer wall to define a heliconic flow chamber of generally annular cross sectional shape having a lower conical chamber segment and an upper cylindrical chamber segment;

pump means for drawing water through an intake formed in a hull of a marine vessel, and for delivering the water with a substantial swirling action to said heliconic flow chamber, said pump means including a mixed centrifugal and axial flow impeller disposed generally at said apex end whereby a substantial portion of said lower conical chamber segment and whereby said upper cylindrical chamber segment are unoccupied by said impeller;

at least one discharge conduit having an upstream end connected to said upper cylindrical segment of said housing means and extending substantially tangentially from said heliconic flow chamber for substantially tangential discharge flow of water from said flow chamber; and nozzle means at a downstream end of said at least one discharge conduit for discharging water in the form of a high velocity water jet directed outwardly from the hull of the vessel, thereby producing a reaction force for vessel maneuvering.

2. The thruster system of claim 1 further including valve means mounted along said at least one discharge conduit and movable between open and closed positions for respectively permitting and preventing water flow through said conduit.

3. The thruster system of claim 2 wherein said valve means has a generally X-shaped profile in the open position to minimize swirl flow through said discharge conduit.

4. The truster system of claim 1 further including a spiral vane within said heliconic flow chamber for inhibiting recirculation flow therein.

5. The thruster system of claim 1 wherein said impeller is disposed below said heliconic flow chamber.

6. The thruster system of claim 1 further including stabilizer vanes mounted within said heliconic flow chamber.

7. The thruster system of claim 1 wherein said at least one discharge conduit comprises a pair of said discharge conduits extending from said heliconic flow chamber generally in opposite directions therefrom.

8. The thruster system of claim 7 wherein said pair of discharge conduits extend from said heliconic flow chamber, with a substantially linear shape, respectively to port and starboard sides of the vessel's hull.

9. The thruster system of claim 7 further including a third discharge conduit extending from said heliconic flow chamber in a generally aft direction relative to the vessel's hull, said third discharge conduit having a discharge nozzle at a downstream end thereof for discharging a high velocity water jet generally in an aft direction relative to the vessel's hull.

10. The thruster system of claim 9 wherein said discharge nozzle at the downstream end of said third discharge conduit is nested closely against the underside of the vessel's hull.

11. The thruster system of claim 9 further including a fourth discharge conduit extending from said heliconic flow chamber in a generally forward direction relative to the vessel's hull, said fourth discharge conduit having a discharge nozzle at a downstream end thereof for discharging a high velocity water jet generally in a forward direction relative to the vessel's hull.

12. The thruster system of claim 7 further including valve means mounted along each of said discharge conduits for movement between open and closed positions respectively opening and closing said discharge conduits to water flow, and control means for selectively opening and closing said valve means.

13. The thruster system of claim 1 further including an auxiliary impeller mounted for rotation with said pump means and disposed substantially at said intake, said auxiliary impeller producing a centrifugal action at the periphery thereof for displacing floating debris away from the intake.

14. A thruster system for a marine vessel, comprising:

housing means having a lower end defining an intake for upward inflow of water through a hull of a marine vessel, said housing means further defining an outer wall having a lower conical segment expanding diametrically in an upward direction and joined to an upper cylindrical segment, a top wall closing the upper end of said housing means, and a flow forming wall disposed centrally within said housing means and cooperating with said outer wall to define a heliconic flow chamber;

pump means for delivering water through said intake to said heliconic flow chamber, said pump means including a mixed centrifugal and axial flow impeller disposed within said housing means substantially at said intake whereby a substantial portion of said heliconic flow chamber is unoccupied by said impeller, and means for rotating said impeller to deliver water to said flow chamber with a substantial swirling action;

a plurality of discharge conduits each having an upstream end connected to said cylindrical segment and extending substantially tangentially from said heliconic flow chamber for substantially tangential discharge flow of water from said flow chamber;

nozzle means at the downstream end of each of said discharge conduits for discharging water in the form of a high velocity water jet directed outwardly from the hull of the vessel, thereby producing a reaction force for vessel maneuvering; and valve means mounted along each of said discharge conduits for movement between open and closed positions respectively opening and closing said discharge conduits to water flow.

15. The thruster system of claim 14 further including a spiral vane within said lower conical segment of said housing means for inhibiting recirculation flow therein.

16. The thruster system of claim 14 wherein said plurality of discharge conduits comprises a pair of said discharge conduits extending from said heliconic flow chamber generally in opposite directions therefrom.

17. The thruster system of claim 16 wherein said pair of discharge conduits extend from said heliconic flow chamber, with a substantially linear 18. The thruster system of claim 16 further including a third discharge conduit extending from said heliconic flow chamber in a generally aft direction relative to the vessel's hull, said third discharge conduit having a discharge nozzle at a downstream end thereof for discharging a high velocity water jet generally in an aft direction relative to the vessel's hull.

19. A liquid pump system, comprising:

housing means forming a heliconic flow chamber, said housing means including a generally annular outer wall having a conical segment expanding from an inlet disposed at an apex end thereof to an opposite end, a generally cylindrical segment having a first end joined coaxially to said opposite end of said conical segment and extending therefrom to a second end, a closure wall for closing said second end of said cylindrical segment, and a flow forming wall disposed centrally within said housing and cooperating therewith to define said heliconic flow chamber of generally annular cross sectional shape having a conical chamber segment and a cylindrical chamber segment;

pump means for delivering a liquid to said inlet of said heliconic flow chamber with a substantial swirling action, said pump means including a mixed centrifugal and axial flow impeller disposed generally at said apex end whereby a substantial portion of said conical chamber segment and whereby said cylindrical chamber segment are unoccupied by said impeller; and at least one discharge conduit extending substantially tangentially from said cylindrical segment of said heliconic flow chamber for substantially tangential discharge flow of the liquid from said flow chamber.

20. The liquid pump system of claim 19 wherein said inlet of said heliconic flow chamber is disposed at a lower end of said housing means.

* * * * *